United States Patent [19]

Merzhanov et al.

[11] Patent Number: 5,053,192

[45] Date of Patent: Oct. 1, 1991

[54] METHOD FOR MAKING PRODUCTS FROM POWDERED MATERIALS

[76] Inventors: Alexandr G. Merzhanov, ulitsa Tretya, 3, kv. 2; Alexandr M. Stolin, Institutsky prospekt,6,kv.86; Vadim V. Podlesov, Shkolny bulvar,11,kv.17; Leonid M. Buchatsky, ulitsa Lesnaya,5,kv.99; Tatyana N. Shishkina, ulitsa Tsentralnaya,18,kv,110, all of Moskovskaya oblast, poselok Chernogolovka, U.S.S.R.

[21] Appl. No.: 566,360

[22] PCT Filed: Dec. 20, 1988

[86] PCT No.: PCT/SU88/00274

§ 371 Date: Aug. 23, 1990

§ 102(e) Date: Aug. 23, 1990

[87] PCT Pub. No.: WO90/07015

PCT Pub. Date: Jun. 28, 1990

[51] Int. Cl.[5] ..... B22F 3/24

[52] U.S. Cl. ..... 419/10; 419/12; 419/17; 419/28; 419/45; 419/48

[58] Field of Search ..... 419/10, 12, 28, 45, 419/17, 178

[56] References Cited

U.S. PATENT DOCUMENTS 4,673,550 8/1987 Dallaire et al. ..... 419/12

4,746,363 5/1988 DeAngelis ..... 419/12

*Primary Examiner*—Stephen J. Lechert, Jr.

*Attorney, Agent, or Firm*—Burgess, Ryan & Wayne

[57] ABSTRACT

The invention relates to the powder metallurgy. The invention involves deforming combustion products by extrusion at an extrusion temperature chosen in the range from $0.3T_1$ to $T_2$, wherein $T_1$ is the melting point of a hard phase of the combustion products and $T_2$ is the melting point of a binder material in a container (5) made up of vertically extending segments (12) defining spaces (13) with one another and having a die (14) and a heat insulated sizing member (17) the temperature conditions of extrusion being controlled by means of a unit (21) having a temperature pick-up (22) and a member (23) receiving information from the pick-up (22) and sending a command for moving the punch (10).

1 Claim, 3 Drawing Sheets

METHOD FOR MAKING PRODUCTS FROM POWDERED MATERIALS

TECHNICAL FIELD

The invention relates to the powder metallurgy and, in particular, it deals with a method and apparatus for making products from powdered materials.

BACKGROUND OF THE INVENTION

Known in the art is a method for making products from powdered heat-resistant materials by hot impact extrusion, comprising preparing cylindrical compacts by using conventional techniques of powder metallurgy, hydrostatic pressing of compacts under a pressure of 150 to 460 $MN/m^2$, sintering them in vacuum at up to 1450° C. during 1 to 6 hours, and subjecting the compacts to hot dynamic extrusion with glass lubricant, with subsequent annealing in vacuum during one hour (Abstr. Jr. "Metallurgia", 1981, 1Г445; City of London Polytechnic, Dep. of Metallurgy and Materials. Ill. 12; Table ; ref. 9. "Hot Impact Extrusion and Subsequent Treatment of Some High-Temperature Nickel Alloys"). The dynamic extrusion allows high-temperature nickel-based alloys containing less than 50% of a high-melting component to be processed, and in certain applications it is capable of hot hardness, lowering porosity and distribution of particles in the material.

The main disadvantages of this method are due to its multiple-stage implementation which results in a substantial energy consumption, the need to use sophisticated production equipment, long process time and high labour effort. In addition, it is known that sophisticated alloys containing more than 50% of a high-melting component are not suitable for dynamic extrusion because of high hot and hardness.

Known in the art is a method for making products from hard alloy composite comprising carrying out a combustion reaction in a mixture of starting powders (metal, nonmetal and binder), with subsequent deformation of the mixture by three-dimensional compression ("New Methods for Making High-Temperature Materials Based on Combustion". Merzhanov A. G., Borovinskaya I. P., Yukhvid V. I., Ratnikov V. I. in the book "Scientific Fundamentals of Materials Technology" (in Russian). Moscow, Nauka Publishing House, 1981. pp. 193-206). This method can be regarded as a modification of hot pressing in which the combustion process prepares components for deformation of the material synthesis and heating). This method was used for making a tungsten-free hard alloy from elements (Ti, C, Ni, Mo). The mixture is blended for obtaining industrial alloys (titanium carbide with 20 and 30% of nickel and molybdenum binder). Materials with rather good properties close to commercially applicable grades can be produced under certain conditions. The method of self-propagating high-temperature synthesis under compression is used nowadays also for producing compact material from individual high-melting compounds.

The abovementioned method makes it possible to produce hard-alloy materials and products in a single stage during a short time period (about one munite) with minimum energy consumption.

The main disadvantage of the method is the limitation of configuration of products so that elongated products, i.e. products having a large length-to-diameter ratio ($h/d >> 1$) are produced. The non-uniform three-dimensional compression pattern used in this method results in mainly compressive stresses being built up in the material. For this reason, if products with $h/d > 1$ are made by this method, they loose the initial shape with fracturing and underpressing.

Known in the art is a method of self-combustion sintering of ceramics under pressure, comprising propagation of exothermal synthesis reaction under a high pressure, wherein the synthesis and compaction of the sintered material are carried out in a blended powdery mixture containing elements necessary for the synthesis (Miyamoto K., Kamija H., Koizumi M. "High-Pressure Self-Combustion Sintering of Ceramics." Funtai oyobi Funmatsu Jaken. 1987, vol. 34. No. 3. pp. 101-196 (JP) CA 107 No 1. p. 266 (119811H). Abstr Jr. Khimia 1988, vol. 13, p. 11, 7E, 13M).

In this method, heat released as a result of the synthesis reaction is the source of energy for sintering under pressure. A thermal impulse should be applied to the mixture to initiate the process (by causing a current of 200-400A to flow during 3 seconds) whereafter the process occurs very rapidly (for about several seconds). High-melting materials such as $TiB_2$, $ZrB_2$, $NbB_2$, TiC, SiC as well as composition materials and products on their base can be manufactured using this simultaneous synthesis and sintering.

Known in the art is an apparatus for carrying out this method comprising a reactor in which is placed into a high-pressure chamber. The reactor is in the form of a hexahedron of pyrophillite having boron nitride liners in which a starting mixture is charged. The mixture is ignited at one point or at the entire side surface thereof.

Advantages of the above described method and apparatus reside in a short process time and low power requirements. Disadvantage include equipment difficulties (an individual reactor is necessary for each size and shape of product), low productivity because the reactor should be placed in the high-pressure chamber, and product size limitation which is also imposed by the construction of the apparatus.

The most similar to the invention is a method for making products from powdered materials selected from the group consisting of at least one transition metal, at least one nonmetal, and at least one metal-based binder material, comprising preparing a powdery mixture of said materials, initiating a combustion reaction therein with the formation of a solid phase from said transition metal and nonmetal in the combustion products, with subsequent deformation of the combustion products and removal of the finished product.

Known in the art is an apparatus for carrying out this method, comprising a mold having a container for a powdery mixture, a device for initiating a combustion reaction in the mixture in the container, a punch for deforming the combustion products in the container, and a press for developing pressure for deforming the combustion products having a ram operatively connected to the punch and ram movement control system (Richardson G. Y., Rice R. W., McDonough W. J., Kunet J. M., Schroeter T. "Hot Pressing of Ceramics Using Self-Propagating Synthesis". Ceram. Eng. Sci. Proc. 1986, vol. 7, No. 7-8, pp. 761-770. Abstr. Jr. "Khimia., M., 1987, No. 4, 4II20).

In accordance with this method, the starting mixture is briquetted and placed into the apparatus.

The apparatus for carrying out the method comprises a graphite mold with a punch and a container lined with a layer of a fibrous ceramic insulation 1.5 cm thick. This facility makes it possible to carry out the induction heating of the mold to a high temperature (1000° C.). Before initiation of the combustion reaction, a pressure of 34 MPa is applied to the briquet in the mold. The device for initiating the combustion reaction in the mixture is located outside the mold container, and a combustion wave propagates through the powdery mixture contained in a passage of the mold base, up to the briquet. After the ignition of the reagents the pressure materially drops (to about 50% of the initial value), and the pressure is then again raised to 34 MPa during about two seconds and is kept at this level during 5 to 10 minutes. The material is compacted by a hot forming press having a control system.

This method was used to make TiC-based materials containing 10–30 vol. % of Ti as binder and also TiC-$TiB_2$-based materials.

The above-described method and apparatus cannot be used for making elongated products (with a height-to-diameter ratio much greater than unity) because of the axial pressing resulting in compressive stresses only being built up in the material. Samples produced in the above described apparatus are in the form of discs 2.8 cm in diameter and 0.3 cm thick. Attempts to obtain products with $h/d>>1$ with such a loading pattern ended in fracturing of the sample and underpressing of certain portions.

In addition, there is no control of temperature of the material, which may result in non-uniformity of structure and composition of the material over the volume of the product. This inhomogeneity generally occurs in deforming materials in which components are in different states, e.g. the hard base is in the solid state and the metal binder is in the liquid state.

SUMMARY OF THE INVENTION

The main object of the invention resides in providing a method for making products from powdered materials and an apparatus for realization thereof wherein the products of combustion would be so deformed as to make compact long-measure products ($h/d>>1$) with homogeneous structure and composition throughout their volume.

This object is accomplished by a method for making products from powdered materials selected from the group consisting of at least one transition metal, at least one nonmetal, and at least one metal-based binder material, comprising preparing a powdery mixture of said materials, initiating a combustion reaction therein with the formation of a solid phase from said transition metal and nonmetal in the combustion products, with subsequent deformation of the combustion products and removal of the finished product; according to the invention, the combustion products are deformed by extrusion at an extrusion temperature of the combustion products ranging from $0.3T_1$ to $T_2$, wherein $T_1$ is the melting point of the solid phase of the combustion products and $T_2$ is the melting point of the binder and under a pressure P ranging from 2000 to 5000 kg/cm$^2$.

When the combustion products are exposed to a temperature ranging from the combustion temperature to the melting point of the binder material, processes of formation of a crystalline structure from completely reacted materials of the starting mixture have time to occur, and impurity gases available in the mixture are removed. The latter results in a lower porosity and lower requirements imposed on purity of materials of the starting mixture. Carrying out extrusion of the combustion products after the solidification of the binder material ensures homogenity of structure and composition lengthwise of the product.

The temperature range of the extrusion process is determined in accordance with the following specific requirements:

of the cure is carried out to a temperature $T<0.3T_1$, deformation of the combustion products will occur in accordance with dry friction laws (crystallographic dislocation) which calls for substantial mechanical forces; temperature gradients are high, and relaxation of thermoelastic stresses occurs mainly through fracturing;

if the cure is carried out to a temperature $T>T_2$, thermal processes after the passage of the combustion wave will not have time to form a crystalline structure. As the binder material available in the starting mixture is in the molten state at the combustion temperature, this will contribute to its spread in the structural framework of the hard phase of the combustion products and to a uniform distribution of the binder in both longitudinal and transverse directions. However, if the extrusion begins with $T>T_2$, non-uniform three-dimensional redistribution of the binder lengthwise of a sample occurs owing to strong differences between mobilities of the molten binder material and hard phase.

Therefore, the abovementioned temperature range ($0.3T_1$–$T_2$) of the extrusion process ensures the retention of plastic properties of the hard phase of the combustion products. Carrying out extrusion at a temperature $T<0.3T_1$ results in a loss of plastic properties of the hard phase. Carrying out extrusion at a temperature $T>T_2$ cannot provide conditions for uniform distribution of the binder material between hard phase grains.

This object is also accomplished by an apparatus for making products from powdered materials, comprising a mold having a container with an interior space for a powdery mixture, a device for initiating a combustion reaction in the mixture in the interior space of the container, a punch for deforming the combustion products in the interior space of the container, and a press for developing pressure for deforming the combustion products having a ram operatively connected to the punch and a ram movement control system, according to the invention, the container is made up of vertically extending segments defining spaces with one another for removing gases from the apparatus, and a die with an orifice, having a conical entry portion conjugated with the die orifice and with the interior space of the container and a heat insulated sizing member for imparting a form to the product are provided, the cross-sectional configuration of the sizing member corresponding to the configuration of the die orifice, the ram movement control system having a unit for controlling temperature conditions of extrusion comprising a temperature pick-up provided on the surface of the conical entry portion of the die and a member electrically coupled to the pick-up and press for sending a command for moving the punch.

The combination of the abovementioned structural elements of the apparatus ensures the implementation of the energy-saving method for making elongated products from powedred materials by combining the combustion reaction in an exothermal mixture of starting components and subsequent extrusion of the combustion products with utilization of heat of this reaction.

The provision of the die having the conical entry portion and the heat-insulated guide sizing member having its orifice which is identical to the die orifice makes it possible to obtain elongated products of preset cross-sectional configurations with a high length-to-diameter ratio without buckling and fractures.

The construction of the container made up of vertically extending segments contributes to the most efficient removal of impurity gases released during combustion along the whole height of the blank through the spaces between the segments. Complete degassing can thus be ensured by the beginning of extrusion so that a compact part can be produced without shells and large pores.

In addition, this construction of the container ensures its high resistance to cyclic thermal loads which is very important as a combustion temperature of the mixture is as high as 1500°-3000° C.

The provision of the unit for controlling temperature conditions of extrusion in the press control system allows high-quality products to be made in the apparatus with homogeneous structure and composition over product volume. This is due to the fact that the temperature pick-up provided on the conical surface of the die senses the material temperature in the zone of maximum heat removal, and the member obtaining information from the pick-up is adjusted to a preset extrusion temperature in the range from $0.3T_1$ to $T_2$ and sends a command for moving the punch when this temperature is reached.

The device for initiating the combustion reaction is preferably provided inside the punch. This simplifies construction of the apparatus and facilitates the process as there are no obstacles during extrusion of the material through the die orifice, and preparation for the next cycle is only reduced to the replacement of a tungsten filament.

BRIEF DESCRIPTION OF THE DRAWINGS

The invention will now be described with reference to a specific embodiment illustrated in the accompanying drawings, in which.

Best Mode for Carrying Out the Invention

A method for making products from powdered materials according to the invention is carried out in the following manner. Starting powders comprise at least one transition metal of groups IV,V,VI of the periodic table of the chemical elements, at least one nonmetal selected from the group consisting of C,B,Si,S,Se, and at least one binder based on a metal of groups IV,V,VI of the periodic table of the chemical elements as well as Fe, Co, Ni, Cu.

Batches of the abovementioned powders are placed in a ball mill and blended using conventional techniques.

The blended powdery mixture is deformed into compacts in a steel mold used for compaction. The compacts are then withdrawn from the mold and heat insulated with asbestos fabric. The compacts are then placed into a mold for extrusion, and a combustion reaction is initiated in the mixture by causing current to flow through a tungsten filament, the resultant material being cured after completion of the reaction.

During the cure, degassing of the combustion products and formation of their crystalline structure occur. When the material temperature drops from the combustion temperature to the extrusion temperature determined by the formula $T=0.3T_1+T_2$, wherein T is the temperature of extrusion of the combustion products, $T_1$ is the melting point of the hard phase of the combustion products, and $T_2$ is the melting point of the binder material, a pressure P ranging from 2000 to 5000 $kg/cm^2$ is applied, and the combustion products are extruded through the die. After cooling of the finished product to room temperature it is removed from the mould.

Figure 1:
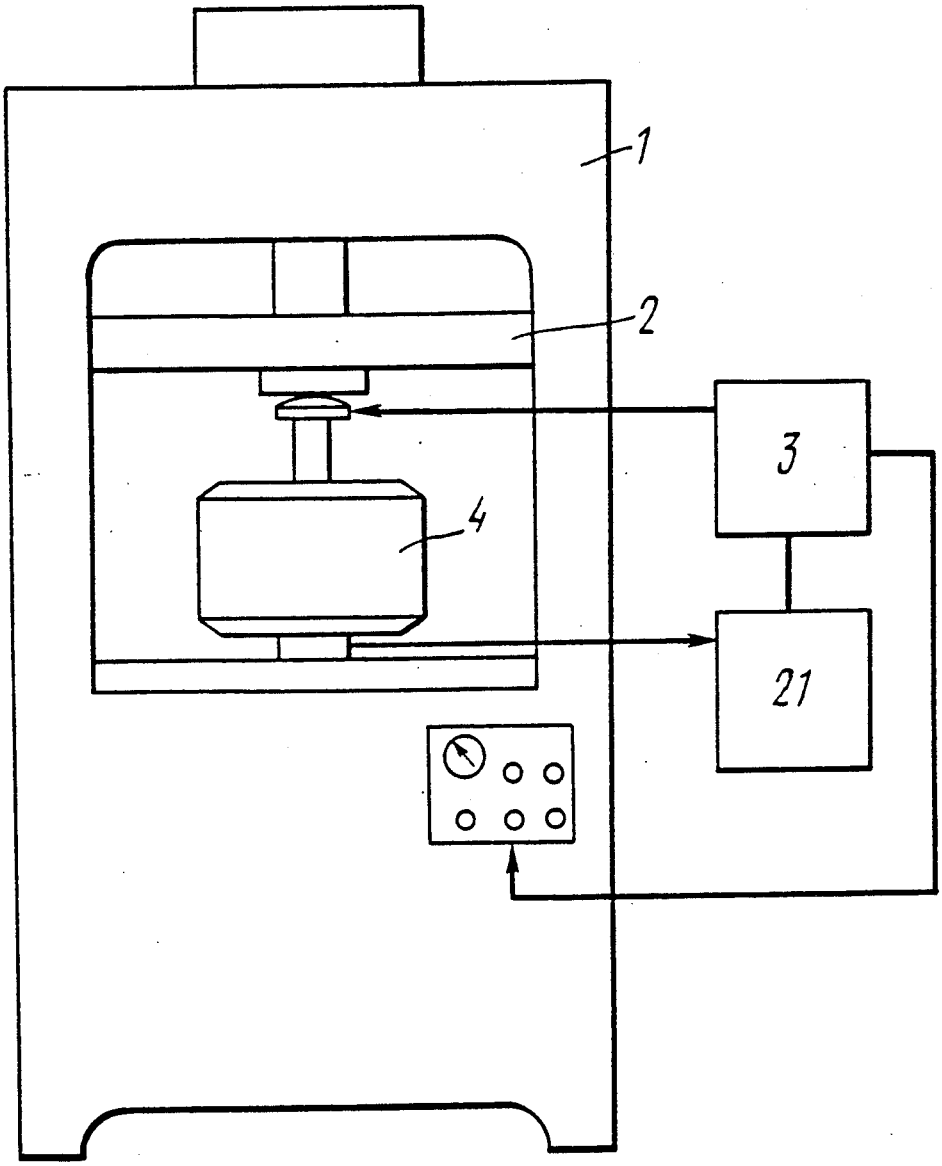
FIG. 1 shows a general diagrammatic view of an apparatus for making products from powdered materials.
Figure 2:
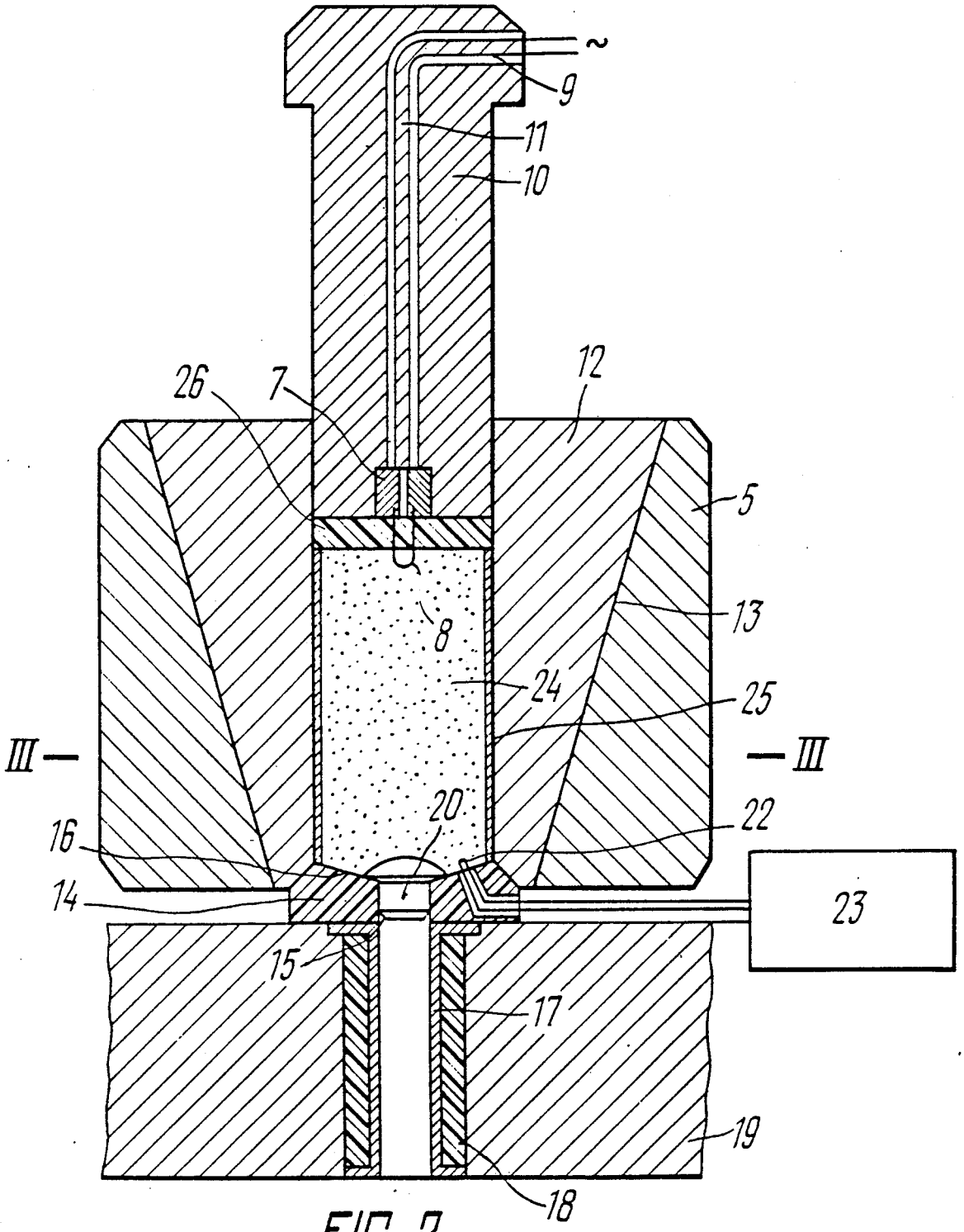
FIG. 2 is a diagrammatic view, in longitudinal section, of an extrusion mold.
Figure 3:
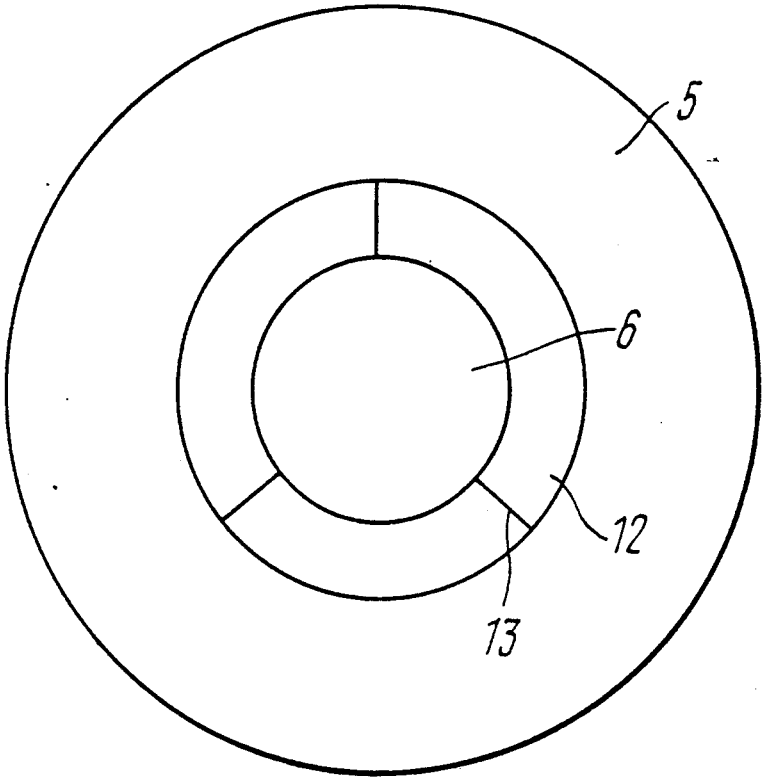
FIG. 3 is a sectional view taken along line III—III in FIG. 2.

The method is carried out in an apparatus for making products from powdered materials according to the invention, which comprises a press 1 (FIG. 1) for developing pressure for deforming the combustion products, which has a ram 2 and a system 3 for controlling movement of the ram 2, an extrusion mold 4 having a container 5 (FIG. 2) which has an interior space 6 (FIG. 3) for a powdery mixture. The apparatus also has a device 7 (FIG. 2) for initiating a reaction of combustion in the mixture in the interior space 6 of the container 5, which has a tungsten filament 8 and leads 9, and a punch 10 having a hole 11 for deforming the combustion products in the interior 6 of the container 5 operatively connected to the ram 2 of the press 1.

According to the invention, the container 5 is made up of vertically extending segments 12 (FIG. 3) with spaces 13 defined between them for the removal of gases from the apparatus. The container 5 has a die 14 (FIG. 2) having an orifice 15 and a conical entry portion 16 conjugated with the orifice 15 of the die 14 and with the interior space 6 of the container 5. The container 5 also has a heat insulated sizing member 17 for imparting a form to products which has a cross-sectional configuration corresponding to the configuration of the orifice 15 of the die 14. The sizing member 17 is lined with a heat insulator 18 and is located in a bed 19 of the press 1.

The orifice 15 of the die 14 is closed by a plug 20.

The system 3 for controlling movement of the ram 2 comprises a unit 21 (FIG. 1) for controlling temperature conditions of extrusion having a temperature pick-up 22 (FIG. 2) provided on the surface of the conical entry portion 16 of the die 14 and a member 23 receiving information from the pick-up 22 and sending a command for moving the punch 10. The member 23 is made in the form of an electronic device which is electrically coupled to the pick-up 22 and to the press 1.

A compact 24 of a powdery mixture is located in the interior space 6 of the container 5 and is heat insulated from the walls of the container 5 by means of asbestos fabric 25 and from the punch 10 by means of a pressure washer 26.

The device 7 for initiating the combustion reaction in the mixture is provided in the hole 11 of the punch 10.

The apparatus for making products from powdered materials functions in the following manner. First the compact 24 is molded from a powdery mixture containing at least one transition metal of groups IV,V,VI of the periodic table of the chemical elements, at least one nonmetal selected from the group consisting of C,B,Si,S,Se, and at least one binder material based on a metal of groups IV,V,VI of the periodic table of the chemical elements and Fe, Co, Ni, Cu.

The compact is covered after molding with a heat insulation in the form of the asbestos fabric 25 on the periphery and placed into the interior space 6 of the container 5. The tungsten filament 8 is inserted into the device 7 for initiating combustion through holes of the pressure washer 26. The punch 10 operatively connected to the ram 2 of the press 1 is lowered until the filament 8 comes in contact with the compact 24. Then the control system 3 electrically coupled to the initiating device 7 and to the unit 21 for controlling temperature conditions of extrusion is switched on. The control system 3 sends a command to apply to the initiating device 7 a voltage of 20 to 50 V during 0.5–2 so that the tungsten filament 8 is heated to initiate the combustion reaction in the compact 24 of the starting mixture. Impurity gases released during combustion are removed through the spaces 13 between the segments 12 of the container 5 along the whole height of the compact 24.

The temperature pick-up 22 in the form of a tungsten-rhenium thermocouple provided on the surface of the conical entry portion 16 of the die 14 records the end of combustion of the compact 24. A signal from the temperature pick-up 22 goes to the member 23 in the form of an electronic device which sends a command for moving the ram 2 and the punch 10 eperatively connected thereto when the preset temperature is reached. The temperature to which the member 23 is preadjusted is chosen in the range from $0.3T_1$ to $T_2$, wherein $T_1$ is the melting point of the hard phase of the combustion products, $T_2$ is the melting point of the binder material.

The press 1 builds up a pressure of 2000 to 5000 kg/cm$^2$ in the tool 4 by means of the punch 10.

When a pressure necessary for the deformation of the material of the plug 20 is built up, the plug is forced through, and extrusion of the material is started through the orifice 15 of the die 14 into the sizing member 17. When a preset pressure in the abovementioned range is reached, the control system 3 sends a command for lifting the ram 2 of the press 1, and the ram moves back to the initial position. The product is removed from the mold 4 after cooling.

The method and apparatus according to the invention may be illustrated by examples of manufacture of bars 8 mm in diameter from various materials.

EXAMPLE 1

Titanium, carbon and nickel powders were used in the following proportioning in % by mass: Ti-56; C-14; Ni-30. The powders were blended in a ball mill, the resultant mixture was molded into 50 g compacts 25 mm in diameter, heat insulated with asbestos fabric 1.5 mm thick and placed into an extrusion mold having the interior space of the container 30 mm in diameter and 8 mm-diameter die orifice. The temperature pick-up (tungsten-rhenium thermocouple) was provided on the surface of the conical entry portion of the die. The tungsten filament was inserted into the electric leads of the initiating device incorporated in the punch. The punch with the initiating device was lowered into the interior of the container until the tungsten filament came in touch with the compact. Voltage of 50 V was applied to the tungsten filament for one second to initiate the combustion reaction in the mixture. The combustion temperature of the mixture was 2000° C. As a result of reaction a TiC-Ni composite was formed. The melting point of the hard phase (TiC) was $T_1=3200°$ C. and the melting point of the binder material (Ni) was $T_2=1456°$ C. The temperature of the synthesized material was continually recorded by the temperature pick-up. After the passage of the combustion wave, the material was cured at a preset temperature which was up to 1400° C. ($T=0.44\ T_1$) in this case. When the preset temperature was reached, the member receiving information from the pick-up sent a command for moving the press ram and the punch operatively connected thereto. The punch built up pressure of 5000 kg/cm$^2$ in the interior of the container. The synthesized material was thus compacted and then extruded through the die orifice into the heat insulated sizing member.

After cooling, the finished product in the form of 8 mm-bar 120 mm long with an even and smooth surface was removed.

The bar had a defect layer of 0.1 mm per diameter. Investigation into the quantitative phase composition at various points of the bar gave the following results in % by mass:

leading portion: TiC-70; Ni-30;

trailing portion: TiC-70; Ni-30.

The data for other examples are given in the Table below.

TABLE

| Example | Composition of starting mixture, % by mass | | | | | Mixture combustion temperature °C. | Temperature of the hard phase, °C. ($T_1$) |
|---|---|---|---|---|---|---|---|
| | Ti | C | Ni | B | Co | | |
| 1 | 56 | 14 | 30 | — | — | 2000 | 3200 (TiC) |
| 2 | 56 | 14 | 30 | — | — | 2000 | 3200 (TiC) |
| 3 | 56 | 14 | 30 | — | — | 2000 | 3200 (TiC) |
| 4 | 58.7 | 6.4 | — | 14.9 | 20 | 2500 | 2500 (eutectic TiC + $TiB_2$) |
| 5 | 84 | 16 | — | — | — | 2200 | 3200 (TiC) |

| Example | Temperature of the binder material, °C. ($T_2$) | Extrusion temperature °C. (T) | Product length, mm | Defect layer, mm | Deviation of phase content lengthwise of the product, % |
|---|---|---|---|---|---|
| 1 | 1456 (Ni) | 1400 ($0.44T_1$) | 110 | 0.1 | 0 |
| 2 | 1456 (Ni) | 1200 ($0.38T_1$) | 106 | 0.1 | 0 |
| 3 | 1456 (Ni) | 1000 ($0.31T_1$) | 102 | 0.1 | 0 |
| 4 | 1490 (Co) | 1000 ($0.40T_1$) | 100 | 0.1 | 0 |
| 5 | 1680 (Ti) | 1500 ($0.47T_1$) | 115 | 0.1 | 0 |

The method and apparatus according to the invention make it possible to obtain a large range of products with various cross-sectional configurations and with unlimited height-to-diameter ratios.

Products obtained by this method feature homogeneous structure and composition over the whole volume and high surface finish; they require but a minimum machining.

INDUSTRIAL APPLICABILITY

The invention may be most advantageously used for making elongated round-section products from high-melting inorganic powdered materials, e.g. punch rolls, tool stems and the like.

The invention may also be used for producing shaped products of various cross-sectional configurations.

What is claimed is:

1. A method for making products from powdered materials selected from a group consisting of at least one transition metal, at least one non-metal and at least one binder based on a metal from the periodic table, comprising preparation of a powder-like mixture from said materials, initiation of combustion reaction therein with formation of a hard phase in the combustion products from said transition metal and non-metal followed by deformation of combustion products and extraction of the finished product and wherein the combustion products are deformed by extrusion at an extrusion temperature T of the combustion products from 0.3 $T_1$ to $T_2$ where $T_1$ is the melting point of the hard phase of the combustion products and $T_2$ is the melting point of the binder material and at a pressure P ranging from 2000 to 5000 kgf/cm$^2$.

* * * * *